US010181280B2

(12) United States Patent
Hung et al.

(10) Patent No.: US 10,181,280 B2
(45) Date of Patent: Jan. 15, 2019

(54) CHARGE SHARING PIXEL CIRCUIT

(71) Applicant: AU Optronics Corporation, Hsin-Chu (TW)

(72) Inventors: Sen-Chuan Hung, Hsin-Chu (TW); Chia-Yuan Yeh, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 57 days.

(21) Appl. No.: 15/201,961

(22) Filed: Jul. 5, 2016

(65) Prior Publication Data

US 2017/0018221 A1 Jan. 19, 2017

(30) Foreign Application Priority Data

Jul. 16, 2015 (TW) ..... 104123109 A

(51) Int. Cl.

| | |
|---|---|
| ***G09G 3/32*** | (2016.01) |
| ***G09G 3/20*** | (2006.01) |
| ***G09G 3/3266*** | (2016.01) |
| ***G09G 3/3275*** | (2016.01) |

(52) U.S. Cl.

CPC ..... *G09G 3/32* (2013.01); *G09G 3/20* (2013.01); *G09G 3/3266* (2013.01); *G09G 3/3275* (2013.01); *G09G 2300/0847* (2013.01); *G09G 2300/0861* (2013.01); *G09G 2310/08* (2013.01); *G09G 2330/021* (2013.01)

(58) Field of Classification Search

CPC ... G09G 3/3208; G09G 3/30; G09G 2320/045
USPC ..... 345/76, 82
See application file for complete search history.

(56) References Cited

U.S. PATENT DOCUMENTS

| | | | | |
|---|---|---|---|---|
| 8,339,348 | B2 | 12/2012 | Chan et al. | |
| 8,692,820 | B2 | 4/2014 | Liu | |
| 2006/0071884 | A1* | 4/2006 | Kim | G09G 3/3233 345/76 |
| 2008/0036704 | A1* | 2/2008 | Kim | G09G 3/3233 345/76 |
| 2011/0025678 | A1* | 2/2011 | Chung | G09G 3/3233 345/213 |
| 2011/0227893 | A1* | 9/2011 | Bae | G09G 3/3233 345/211 |

(Continued)

FOREIGN PATENT DOCUMENTS

| | | |
|---|---|---|
| CN | 103106862 A | 5/2013 |
| TW | I368206 | 7/2012 |
| TW | I385631 | 2/2013 |

(Continued)

*Primary Examiner* — Yuzhen Shen
(74) *Attorney, Agent, or Firm* — WPAT, PC

(57) ABSTRACT

A pixel circuit includes a first switch unit, a second switch unit, a data line, a charge sharing line and a pixel-driving unit. The pixel-driving unit is electrically connected with the data line and a first terminal of the first switch unit. A second terminal of the first switch unit is electrically connected with the charge sharing line and a first terminal of the second switch unit. A second terminal of the second switch unit is electrically connected with the data line. In a charge sharing period, the voltage value of the data line is determined according to a first data voltage provided by the data line in an initial period and a control voltage provided by the charge sharing line during the initial period.

15 Claims, 11 Drawing Sheets

(56) References Cited

U.S. PATENT DOCUMENTS

| | | | | |
|---|---|---|---|---|
| 2013/0050292 | A1* | 2/2013 | Mizukoshi | G09G 3/3291<br>345/690 |
| 2013/0147694 | A1* | 6/2013 | Kim | G09G 3/32<br>345/82 |

FOREIGN PATENT DOCUMENTS

| | | |
|---|---|---|
| TW | I412852 | 10/2013 |
| TW | I421835 | 1/2014 |
| TW | I431580 | 3/2014 |
| TW | I492206 | 7/2015 |

* cited by examiner

CHARGE SHARING PIXEL CIRCUIT

BACKGROUND

Technical Field

The present invention relates to a pixel circuit, and in particular, to a pixel circuit with a charge sharing function.

Related Art

Along with the advancement of information technologies, applications for displays have increased in popularity. Existing displays are mostly provided with thin panels, and are widely applied to electronic devices such as personal computers, notebook computers, tablet computers, and smart phones. The resolution of the panel is increasingly improved, to provide better image quality to a user. However, along with the increase of the resolution of the panel, power consumption of the panel is also increased.

For a portable electronic product, power consumption caused by a high-resolution panel will generally greatly reduce the time for which a battery-operated device can operate. Therefore, a method and apparatus to reduce the power consumption of the panel is of a considerable importance in this field.

SUMMARY

An aspect of the present invention is to provide a pixel circuit. The pixel circuit includes a first switch unit, a second switch unit, a data line, a charge sharing line, and a pixel-driving unit. The pixel-driving unit is electrically connected with the data line and a first terminal of the first switch unit. A second terminal of the first switch unit is electrically connected with the charge sharing line and a first terminal of the second switch unit. A second terminal of the second switch unit is electrically connected with the data line. In a charge sharing period, the voltage value of the data line is determined according to a first data voltage provided by the data line in an initial period and a control voltage provided by the charge sharing line in the abovementioned initial period.

Another aspect of the present invention is to provide a pixel circuit. The pixel circuit includes a first switch unit, a second switch unit, a data line, a charge sharing line, a first pixel-driving unit, and a second pixel-driving unit. The first pixel-driving unit is electrically connected with the data line. The second pixel-driving unit is electrically connected with the data line and a first terminal of the first switch unit. A second terminal of the first switch unit is electrically connected with the charge sharing line and a first terminal of the second switch unit. A second terminal of the second switch unit is electrically connected with the data line. In a charge sharing period corresponding to the second pixel-driving unit, the voltage value of the data line is determined according to a first data voltage provided by the data line in a compensation period corresponding to the first pixel-driving unit and a control voltage provided by the charge sharing line in an initial period corresponding to the second pixel-driving unit.

Still another aspect of the present invention is to provide a pixel circuit. The pixel circuit includes a plurality of pixel units and a second transistor. Each of the pixel units includes a drive transistor and a first transistor. A gate of the drive transistor is electrically connected with a first terminal of the first transistor. A second terminal of the first transistor of each of the pixel units is electrically connected with the first terminal of the second transistor. A gate of the second transistor is electrically connected with a gate of the first transistor of each of the pixel units.

By using the technical means of the present invention, power that needs to be consumed when the data voltage is provided may be effectively reduced. Particularly, when a difference between the first data voltage and the second data voltage is large, the power consumed when the data voltage is provided may be greatly reduced. In addition, in the present invention, by setting a first transistor for each of the pixel units, and connecting a gate of the first transistor with a gate of a second transistor outside the pixel unit, the first transistor and the second transistor form a dual-gate structure. In this way, the mura effect of the display caused by the leakage current may be effectively alleviated. Moreover, a plurality of pixel units may share one second transistor, and therefore, it is unnecessary to occupy an excessive area on the pixel circuit.

DETAILED DESCRIPTION

Figure 1:
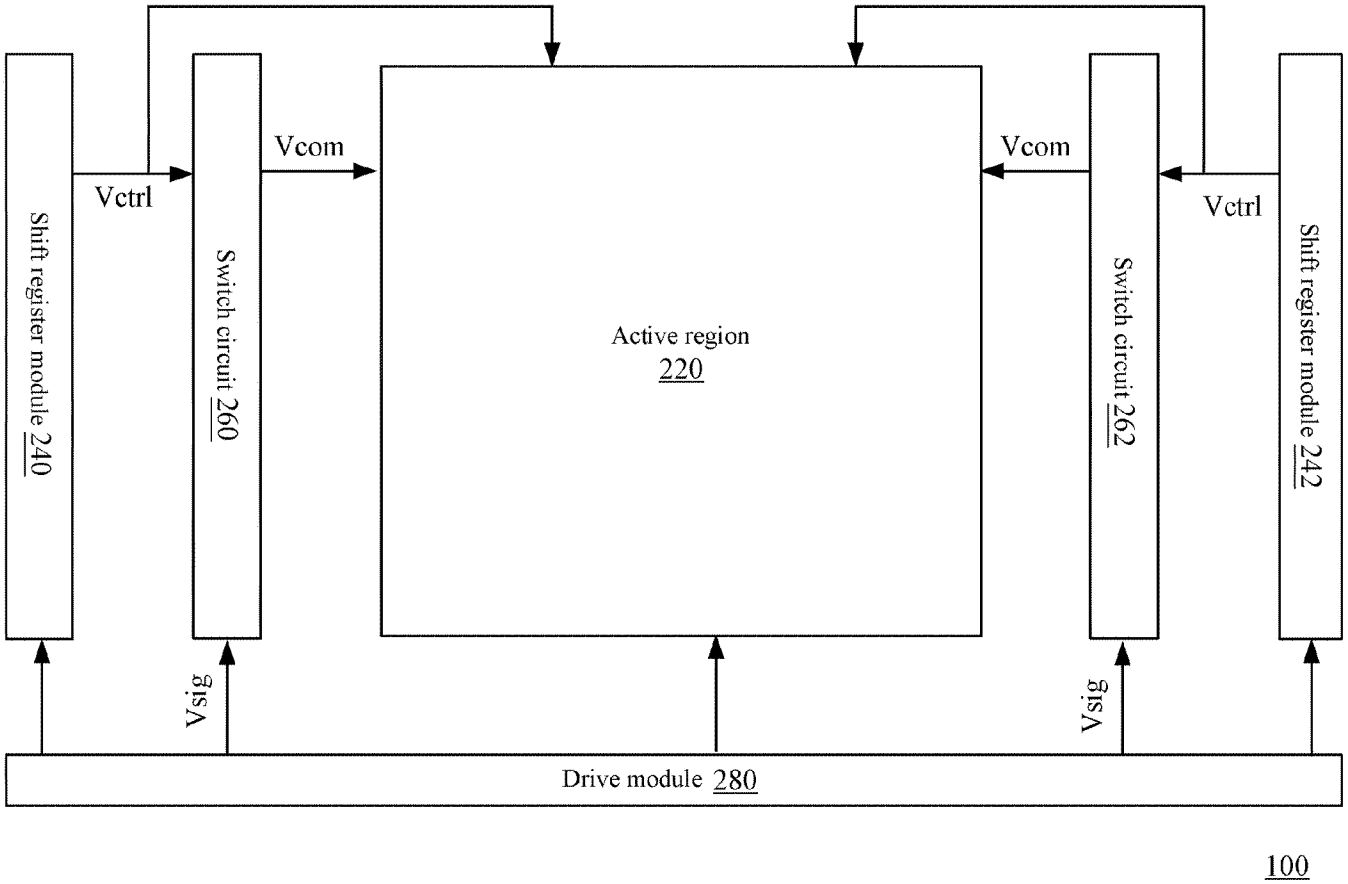
FIG. 1 is a schematic diagram of a display according to an embodiment of the present invention.

Embodiments are described in detail through accompanying drawings in the following; however, the provided embodiments are not intended to limit the scope of the present invention, descriptions of structures and operations are not intended to limit the order of execution, and any structure formed by recombination of elements and generated apparatus having the equivalent effect all fall within the scope of the present invention. Moreover, the accompanying drawings are merely illustrative, and are not drawn according to the original size. For ease of understanding, the same elements in the following descriptions are described with the same reference numerals.

In the whole specification and the claims, terms used, unless particularly specified, generally have their normal meanings in the field, in content of the disclosure and in specific content. Some terms used to describe the present disclosure will be discussed in the following or in another place of the specification, so as to provide addition guidance for a person skilled in the art in terms of the description related to the present disclosure.

In addition, "couple" or "connect" used in the text may both refer to that two or more elements perform direct physical or electrical contact with each other, or perform indirect physical or electrical contact with each other, and may also refer to that two or more elements operate or act with each other.

In the text, unless specifically limited, articles in the text "a" and "the" may generally refer to one or more. It will be further understood that, "include", "comprise", "have" and similar words used in the text indicate features, regions, integers, steps, operations, elements and/or components recorded therein, but not exclude one or more other features, regions, integers, steps, operations, elements, components and/or groups thereof recorded therein or additionally.

In addition, in the text, it is understandable that words such as first, second and third are used to describe various elements, components, regions, layers and/or blocks. However, the elements, components, regions, layers and/or blocks should not be limited by the terms. The words are merely used to distinguish a single element, component, region, layer and/or block. Therefore, in the following text, a first element, component, region, layer and/or block may also be referred to as a second element, component, region, layer and/or block, without departing from the spirit of the present invention.

Referring to FIG. 1, FIG. 1 is a schematic diagram of a display 100 according to an embodiment of the present invention. The display 100 includes shift register modules 240, 242, a drive module 280, and a pixel circuit. Specifically, the pixel circuit includes an active region 220 and switch circuits 260, 262. The active region 220 may include a pixel array formed by a plurality of pixel units, and internal circuit details thereof will be described in detail in the following paragraphs.

The shift register modules 240, 242 may respectively output corresponding control signals Vctrl to the switch circuits 260, 262 according to a signal provided by the drive module 280, and provide the control signals Vctrl to the active region 220, so as to control operations of the switch circuits 260, 262 and the active region 220.

The switch circuits 260, 262 may output corresponding control voltages Vcom to the active region 220 according to the control voltage Vsig provided by the drive module 280 and the control signals Vctrl provided by the shift register modules 240, 242, so as to control the operation of the active region 220. It should be noted that, although the pixel circuit shown in FIG. 1 includes both the switch circuits 260, 262, in some embodiments, the pixel circuit may also merely include the switch circuit 260 or the switch circuit 262. In some embodiments, a group of the shift register module 240 and the switch circuit 260 may be included merely. The embodiment of FIG. 1 is merely exemplary, and is not used to limit this application.

Figure 2:
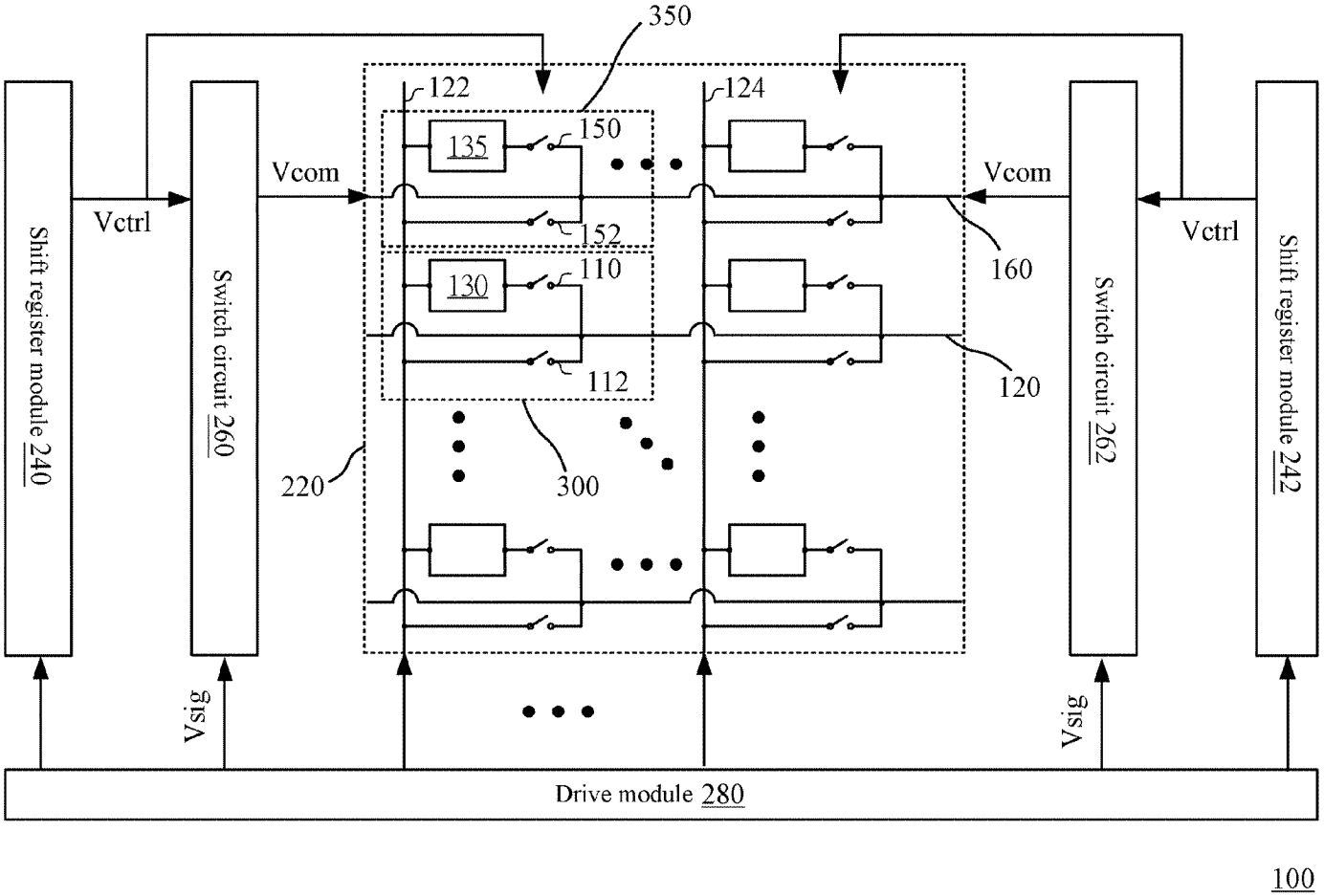
FIG. 2 is a schematic diagram of a display according to an embodiment of the present invention.

Also referring to FIG. 2, FIG. 2 is a schematic diagram of a display 100 according to an embodiment of the present invention. As shown in FIG. 2, in an embodiment, an active region 220 of a pixel circuit includes a pixel array formed by a plurality of data lines 122, 124 and a plurality of charge sharing lines 120, 160. Multiple pixel circuits are respectively coupled to the data lines 122, 124 and the charge sharing lines 120, 160.

As shown in FIG. 2, a pixel unit (for example, a pixel unit 300) includes a first switch unit (for example, a first switch unit 110), a second switch unit (for example, a second switch unit 112), and a pixel-driving unit (for example, a pixel-driving unit 130). Similarly, a first switch unit 150, a second switch unit 152, and a pixel-driving unit 135 form a pixel unit 350, which is not repeated herein.

Switch circuits 260, 262 are used to respectively output corresponding control voltages Vcom to the charge sharing lines 120, 160. Shift register modules 240, 242 are respectively used to output corresponding control signals Vctrl, so as to control the first switch units 110, 150, the second switch units 112, 152 and the pixel-driving units 130, 135 in the active region 220.

Figure 3:
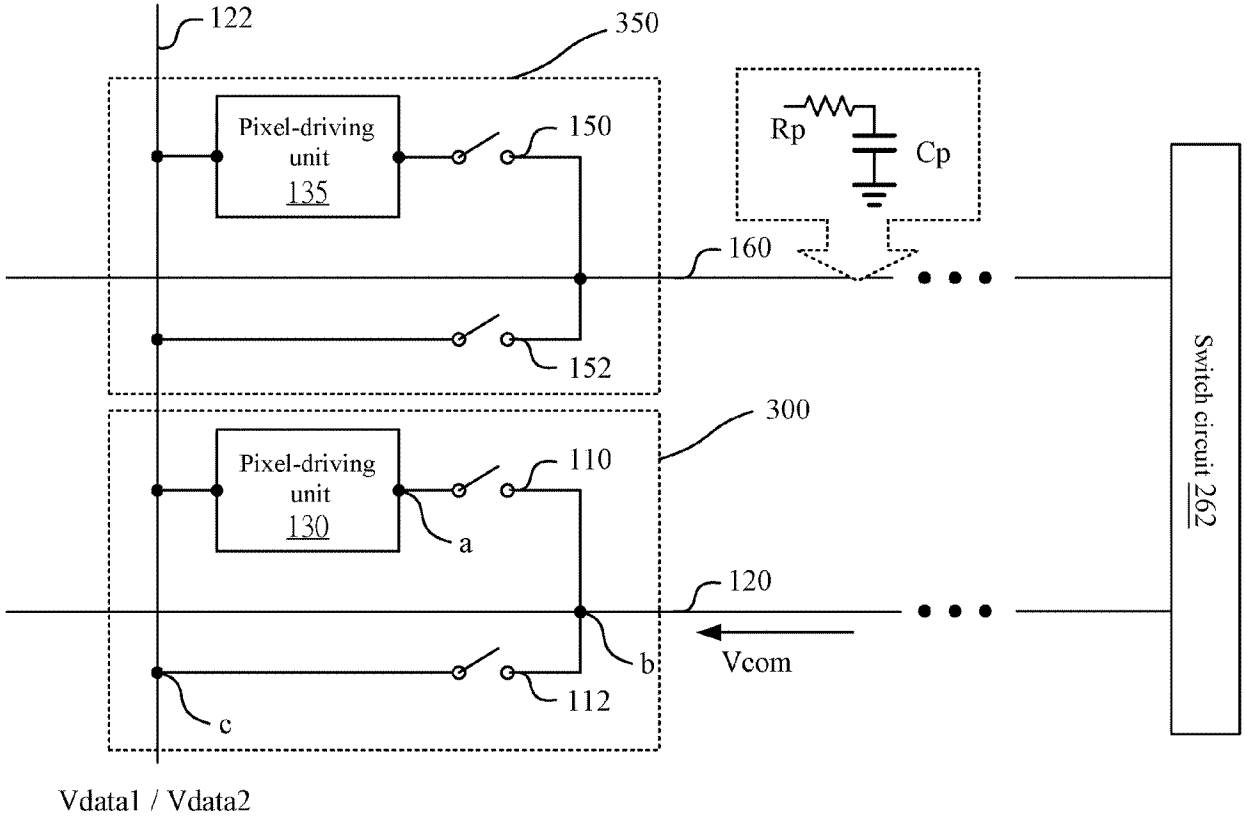
FIG. 3 is a schematic diagram of a pixel circuit according to an embodiment of the present invention.

Referring to FIG. 3, FIG. 3 is a schematic diagram of a pixel circuit according to an embodiment of the present invention. In this embodiment, a pixel unit 300 includes a first switch unit 110, a second switch unit 112, a data line 122, a charge sharing line 120 and a pixel-driving unit 130.

In an embodiment, the pixel unit 300 may be a pixel circuit in a light emitting diode (LED) panel. The pixel-driving unit 130 includes a light emitting diode and a drive circuit thereof (for example, a light emitting diode and a 6T1C light emitting diode drive circuit). The data line 122 is used to provide a data voltage to the pixel-driving unit 130 to control the light emitting diode to emit light.

The pixel-driving unit 130 is electrically connected with the data line 122 and a first terminal (end point a) of the first switch unit 110. A second terminal (end point b) of the first switch unit 110 is electrically connected with the charge sharing line 120 and a first terminal of the second switch unit 112. A second terminal (end point c) of the second switch unit 112 is electrically connected with the data line 122.

In this embodiment, the pixel unit 350 includes a pixel-driving unit 135 adjacent to the pixel-driving unit 130, and a first switch unit 150, a second switch unit 152 and a charge sharing line 160 corresponding to the adjacent pixel-driving unit 135. The adjacent pixel-driving unit 135 may also include a light emitting diode and a drive circuit thereof.

As shown in FIG. 2 and FIG. 3, the pixel unit 350 coupled to the same charge sharing line (for example, the charge sharing line 160) may share a parasitic capacitor Cp and a parasitic resistor Rp on the charge sharing line 160. Specific content thereof will be described in detail in the following embodiments.

Figure 4:
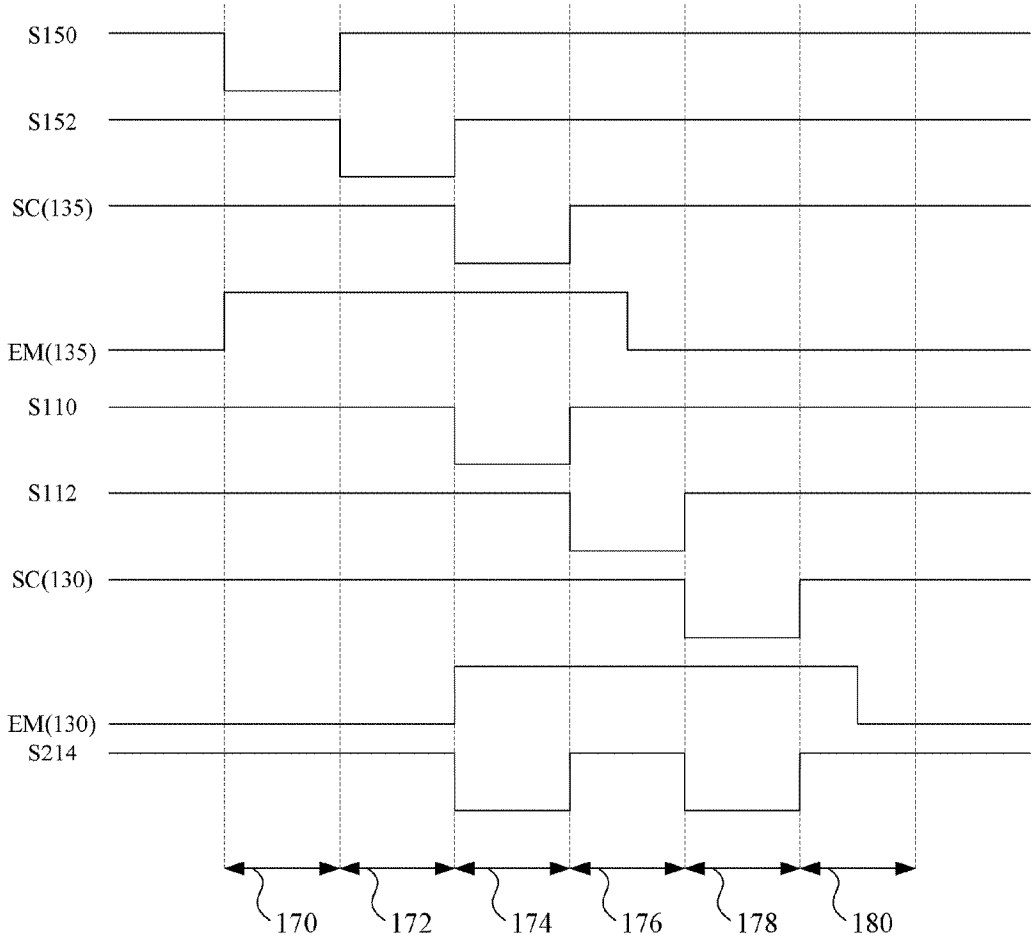
FIG. 4 is an oscillogram of a related signal used to control driving of a pixel circuit.

Also referring to FIG. 4, FIG. 4 is an oscillogram of a related signal used to control driving of, for example, pixel units 300, 350. As shown in FIG. 4, signals S110, S112, S150 and S152 are respectively switch control signals for controlling on and off of the switch units 110, 112, 150 and 152 shown in FIG. 1. Signals SC(130) and SC(135) are respectively scan signals for controlling the pixel-driving unit 130 and the pixel-driving unit 135. Signals EM(135) and EM(130) are respectively light-emission enable signals for controlling the pixel-driving unit 130 and the pixel-driving unit 135.

In addition, a time interval 170 is an initial period corresponding to the pixel-driving unit 135. A time interval 172 is a charge sharing period corresponding to the pixel-driving unit 135. A time interval 174 is an initial period corresponding to the pixel-driving unit 130 and a compensation period corresponding to the pixel-driving unit 135 (the initial period corresponding to the pixel-driving unit 130 and the compensation period corresponding to the adjacent pixel-driving unit 135 are overlapped in time), and a time interval 176 is a light emission period corresponding to the pixel-driving unit 135.

The time interval 174 is the initial period corresponding to the pixel-driving unit 130; and the time interval 176 is a charge sharing period corresponding to the pixel-driving unit 130. A time interval 178 is a compensation period corresponding to the pixel-driving unit 130. A time interval 180 is a light emission period corresponding to the pixel-driving unit 130.

As shown in FIG. 4, in the charge sharing period 176 corresponding to the pixel-driving unit 130, the voltage value of the data line 122 is determined according to a first data voltage Vdata1 provided by the data line 122 in the initial period 174 corresponding to the pixel-driving unit 130, and a control voltage Vcom provided by the charge sharing line 120 in the initial period 174 corresponding to the pixel-driving unit 130.

In the embodiment shown in FIG. 4, the initial period 174 corresponding to the pixel-driving unit 130 and the compensation period corresponding to the adjacent pixel-driving unit 135 are overlapped in time. Therefore, in the initial period 174 corresponding to the pixel-driving unit 130, the data line 122 provides the first data voltage Vdata1 to the adjacent pixel-driving unit 135, to serve as a data voltage of the adjacent pixel-driving unit 135.

In an embodiment, in the initial period 174 corresponding to the pixel-driving unit 130, the first switch unit 110 is switched on (in this case, the signal S110 enables the first switch unit 110), and the second switch unit 112 is switched off (in this case, the signal S112 disables the second switch unit 112). In this case, the charge sharing line 120 provides the abovementioned control voltage to serve as an initial voltage of the pixel-driving unit 130. Therefore, the initial voltage of the pixel-driving unit 130 in the initial period 174 is determined according to the control voltage provided by the charge sharing line 120.

In the embodiment shown in FIG. 4, the charge sharing period 176 corresponding to the pixel-driving unit 130 follows the initial period 174, and the charge sharing period 176 corresponding to the pixel-driving unit 130 and the light emission period corresponding to the adjacent pixel-driving unit 135 are overlapped in time. In the charge sharing period 176, the first switch unit 110 is switched off (in this case, the signal S110 disables the first switch unit 110), and the second switch unit 112 is switched on (in this case, the signal S112 enables the second switch unit 112), so that the voltage value of the charge sharing line 120 and the voltage value of the data line 122 are the same.

Therefore, in this case, the charge sharing line 120 and the data line 122 can share charges. It can be known from the descriptions of the abovementioned paragraphs that, when the initial period 174 ends, the voltage value of the charge sharing line 120 is the abovementioned control voltage Vcom, and the voltage value of the data line 122 is the abovementioned first data voltage Vdata1. Therefore, in the charge sharing period 176, since the second switch unit 112 is switched on, the voltage value of the charge sharing line 120 and the voltage value of the data line 122 are determined according to the abovementioned first data voltage Vdata1 and the abovementioned control voltage Vcom.

In other embodiments, in the charge sharing period 176, the voltage value of the charge sharing line 120 and the voltage value of the data line 122 are determined according to the abovementioned first data voltage Vdata1, the abovementioned control voltage Vcom, a resistance capacitance value (RC value) of the parasitic capacitor and the parasitic resistor of the data line 122, and an RC value of the parasitic capacitor and the parasitic resistor of the charge sharing line 120. For example, if the RC value of the parasitic capacitor and the parasitic resistor of the data line 122 and the RC value of the parasitic capacitor and the parasitic resistor of the charge sharing line 120 are the same, in the charge sharing period 176, the voltage value of the charge sharing line 120 and the voltage value of the data line 122 are an average value of the abovementioned first data voltage Vdata1 and the abovementioned control voltage Vcom.

Then, in the compensation period 178 corresponding to the pixel-driving unit 130, the first switch unit 110 is switched off (in this case, the signal S110 disables the first switch unit 110), the second switch unit 112 is switched off (in this case, the signal S112 disables the second switch unit 112), and the data line 122 provides a second data voltage Vdata2 to the pixel-driving unit 130, to serve as a data voltage of the pixel-driving unit 130. It should be noted that, the compensation period 178 may follow the charge sharing period 176, but the present invention is not limited thereto. Therefore, in the compensation period 178 corresponding to the pixel-driving unit 130, the data line 122 may provide the second data voltage Vdata2 to drive the pixel-driving unit 130.

In the light emission period 180 corresponding to the pixel-driving unit 130, the first switch unit 110 is switched off (in this case, the signal S110 disables the first switch unit 110), and the second switch unit 112 is switched off (in this case, the signal S112 disables the second switch unit 112). The light-emission enable signal EM(130) enables a light emitting element in the pixel-driving unit 130. It should be noted that the light emission period 180 may follow the compensation period 178, but the present invention is not limited thereto.

In addition, descriptions made for operations of the first switch unit 150, the second switch unit 152 and corresponding switch control signals S150, S152 in the initial period 170 and the charge sharing period 172 corresponding to the pixel-driving unit 135 are similar to those for the operations directed to the initial period 174 and the charge sharing period 176 corresponding to the pixel-driving unit 130 in the abovementioned paragraphs, which are not repeated herein. Specifically, the switch control signals S110, S112, S150, S152 and the like may be determined according to the control signal Vctrl output by the shift register module 240 shown in FIG. 2.

Figure 5A:
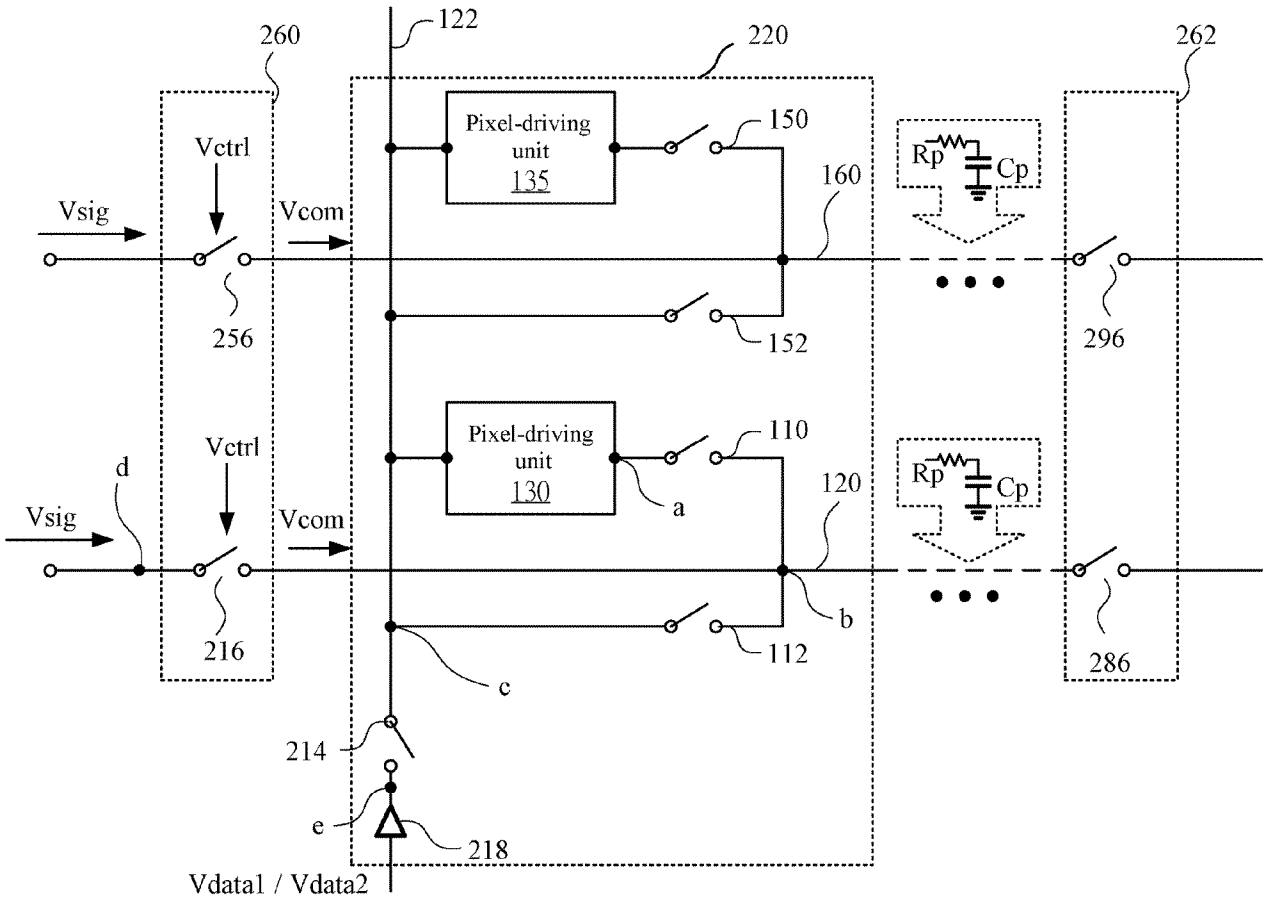
FIG. 5A is a schematic diagram of a pixel circuit according to an embodiment of the present invention.

Referring to FIG. 5A, FIG. 5A is a schematic diagram of a pixel circuit according to an embodiment of the present invention. Compared with the pixel circuit 100 shown in FIG. 2, in this embodiment, the active region 220 further includes a third switch unit 214 and optionally includes a buffer 218. The switch circuit 260 includes fourth switch unit 216, and fifth switch circuit 256. The switch circuit 262 includes fourth switch unit 286, and fifth switch circuit 296.

A first terminal (end point c) of the third switch unit 214 is electrically connected with the data line 122. A second terminal (end point e) of the third switch unit 214 is electrically connected with the buffer 218. The on and off of the third switch unit 214 may be controlled by the switch control signal S214 shown in FIG. 2.

In the initial period 174 corresponding to the pixel-driving unit 130 (that is, the compensation period corresponding to the adjacent pixel-driving unit 135), the third switch unit 214 is switched on (in this case, the signal S214 enables the third switch unit 214), so that the first data voltage Vdata1 output by the buffer 218 is transmitted to the adjacent pixel-driving unit 135 through the third switch unit 214 and the data line 122.

In the compensation period 178 corresponding to the pixel-driving unit 130, the third switch unit 214 is switched on (in this case, the signal S214 enables the third switch unit 214), so that the data line 122 provides a second data voltage Vdata2 to the pixel-driving unit 130. Therefore, in the compensation period 178 corresponding to the pixel-driving unit 130, the second data voltage Vdata2 output by the buffer 218 may be transmitted to the pixel-driving unit 130 through the third switch unit 214 and the data line 122.

It can be known from the abovementioned paragraphs that, in the charge sharing period 176 corresponding to the pixel-driving unit 130, the voltage value of the charge sharing line 120 and the voltage value of the data line 122 are determined according to the abovementioned first data voltage Vdata1, the abovementioned control voltage Vcom, an RC value of the parasitic capacitor and the parasitic resistor of the data line 122, and an RC value of the parasitic capacitor and the parasitic resistor of the charge sharing line 120.

For example, if the RC value of the parasitic capacitor and the parasitic resistor of the data line 122 and the RC value of the parasitic capacitor and the parasitic resistor of the charge sharing line 120 are the same, in the charge sharing period 176, the voltage value of the charge sharing line 120 and the voltage value of the data line 122 are an average value of the abovementioned first data voltage Vdata1 and the abovementioned control voltage Vcom. Therefore, in the compensation period 178 corresponding to the pixel-driving unit 130, for the data line 122, the buffer 218 merely needs to be charged from the average value of the first data voltage Vdata1 and the control voltage Vcom to the second data voltage Vdata2. In this way, the power that needs to be consumed when the data voltage is provided can be effectively reduced. Particularly, when a difference between the first data voltage Vdata1 and the second data voltage Vdata2 is large, the power consumed when the data voltage is provided may be greatly reduced. In an example, under the same condition, the power consumed by the pixel circuit of this application is about 34% of that in the conventional technology, so that the energy consumed by the display may be greatly reduced.

In an embodiment, a first terminal (end point b) of the fourth switch unit 216 is electrically connected with the charge sharing line 120. The on and off of the fourth switch unit 216 may be directly or indirectly controlled by the control signal Vctrl. For example, the on and off of the fourth switch unit 216 may be controlled by the signal S110 shown in FIG. 2 (that is, the fourth switch unit 216 and the first switch unit 110 are switched on and off simultaneously), but the present invention is not limited thereto.

In the initial period 174 corresponding to the pixel-driving unit 130, the fourth switch unit 216 is switched on (in this case, the signal S110 enables the fourth switch unit 216), so that the abovementioned control voltage Vcom is transmitted through the fourth switch unit 216 to the charge sharing line 120. In the charge sharing period 176 corresponding to the pixel-driving unit 130, the fourth switch unit 216 is switched off (in this case, the signal S110 disables the fourth switch unit 216), the first switch unit 110 is switched off, and the second switch unit 112 is switched on, so that the voltage value of the charge sharing line 120 and the voltage value of the data line 122 are the same.

In another embodiment, a second terminal (end point d) of the fourth switch unit 216 is electrically connected with the drive module 280. The drive module 280 is used to provide the abovementioned control voltage Vsig, so that the abovementioned control voltage Vsig may be transmitted through the fourth switch unit 216 (that is, the switch circuit 260) to the charge sharing line 120 as a control voltage Vcom. It should be noted that, the abovementioned control voltage Vsig may be a constant value, and may also be a variable voltage. The drive module 280 may adjust the output control voltage Vsig according to voltage values of the first data voltage Vdata1 and the second data voltage Vdata2, so as to adjust the value of the control voltage Vcom output by the switch circuit 260.

As shown in FIG. 5A, the switch circuit 260 may also include a fourth switch unit 256. An operation of the fourth switch unit 256 relative to the pixel-driving unit 135 is similar to the operation of the fourth switch unit 216 relative to the pixel-driving unit 130, and is not repeated herein. In addition, the switch circuit 262 may optionally include a fourth switch unit 286 and a fourth switch unit 296. An operation of the fourth switch unit 286 relative to the pixel-driving unit 130 is similar to the operation of the fourth switch unit 216 relative to the pixel-driving unit 130, and an operation of the fourth switch unit 296 relative to the pixel-driving unit 135 is similar to the operation of the fourth switch unit 256 relative to the pixel-driving unit 135. The function and operation of the switch circuit 262 are similar to the function and operation of the switch circuit 260.

Figure 5B:
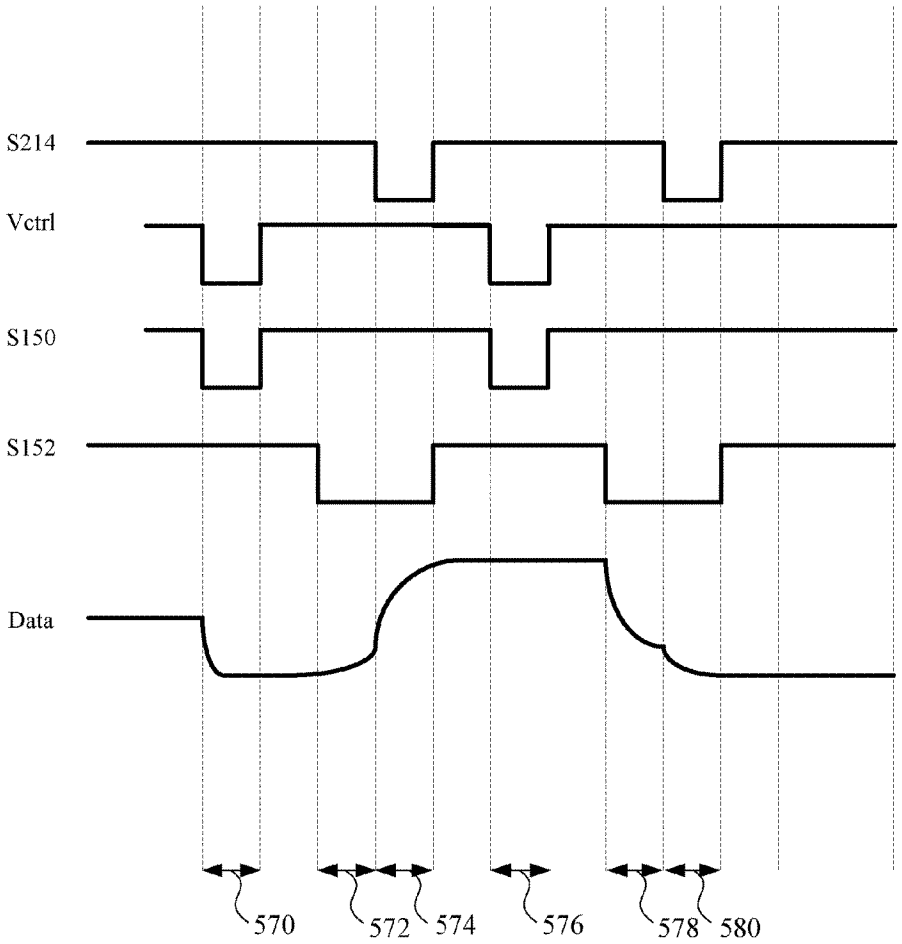
FIG. 5B is an oscillogram of a related signal used to drive the pixel circuit shown in FIG. 5A according to an embodiment of the present invention.

For ease of illustration, please also refer to FIG. 5B. FIG. 5B is an oscillogram of a related signal for driving the pixel circuit shown in FIG. 5A. Signals S214, Vctrl, S150 and S152 are respectively switch control signals for controlling on and off of the switch units 214, 256, 150 and 152 shown in FIG. 5A. A signal Data is a voltage signal on the data line 122.

As shown in FIG. 5B, in an initial period 570 corresponding to the pixel-driving unit 135, the signal S150 enables the first switch unit 150 to be switched on, the signal Vctrl enables the fourth switch unit 256 to be switched on, and the signal S112 disables the second switch unit 152 to be switched off. In this case, the charge sharing line 160 provides the control voltage Vcom to serve as an initial voltage of the pixel-driving unit 135.

Then, in a charge sharing period 572 corresponding to the pixel-driving unit 135, the signal S150 disables the first switch unit 150 to be switched off, and the signal S152 enables the second switch unit 152 to be switched on; therefore, the voltage value of the charge sharing line 160 and the voltage value of the data line 122 are the same, and the charge sharing line 160 and data line 122 may share charges. In this way, the data line 122 has been pre-charged in this period (in some embodiments, the voltage value of the data line 122 is an average value of the first data voltage Vdata1 originally on the data line and the control voltage Vcom originally on the charge sharing line 160).

Then, in a compensation period 574 corresponding to the pixel-driving unit 135, the signal S214 enables the third switch unit 214 to be switched on, and therefore, the data line 122 provides a second data voltage Vdata2 to the pixel-driving unit 135, to serve as a data voltage of the pixel-driving unit 135. The data line 122 has been partially pre-charged through the charge sharing line 160, and therefore, energy required for charging to the second data voltage Vdata2 is small, thereby effectively reducing the power required to be consumed when the data voltage is provided.

Similarly, in the initial period 576, the charge sharing period 578, and the compensation period 580 correspondingly in another cycle, the data line 122 may also perform partial discharging through the charge sharing line 160 in the charge sharing period 578, and descriptions made for operations thereof are similar to those for the operations directed to the initial period 570, the charge sharing period 572 in the abovementioned paragraphs, and the compensation period 584, which are not repeated herein.

Figure 6A:
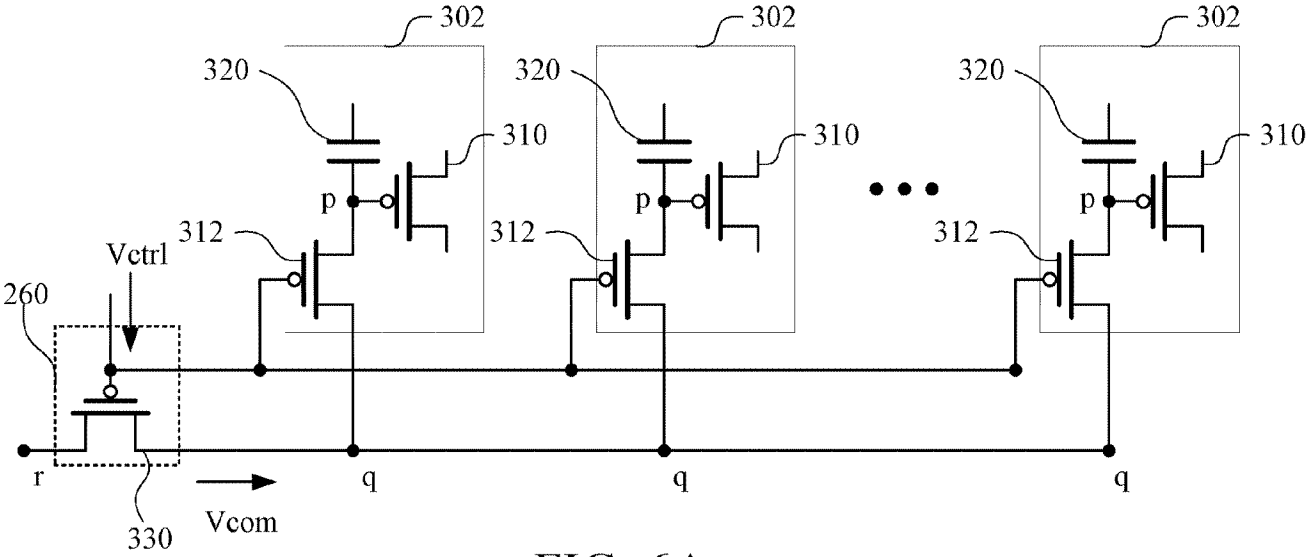
FIG. 6A is a schematic diagram of a pixel circuit according to an embodiment of the present invention.

Referring to FIG. 6A, FIG. 6A is a schematic diagram of a pixel circuit 600 according to an embodiment of the present invention. In the pixel circuit 600, an active region 220 includes a plurality of pixel units 302, a switch circuit 260 includes a second transistor 330 (equivalent to the fourth switch unit 216 or 256 in FIG. 5A).

Each of the pixel units 302 includes a drive transistor 310 and a first transistor 312. A gate of the drive transistor 310 is electrically connected with a first terminal (end point p) of the first transistor 312. In an embodiment, the drive transistor 310 is used to provide a drive current to a light emitting element (not shown) in the pixel unit 302. The abovementioned light emitting element may be a light emitting diode, and the drive transistor 310 may be a drive transistor in a light emitting diode drive circuit (for example, a 6T1C light emitting diode drive circuit).

A second terminal of the first transistor 312 of each of the pixel units 302 is electrically connected with a first terminal (end point q) of the second transistor 330, and a gate of the second transistor 330 is electrically connected with a gate of the first transistor 312 of each of the pixel units 302.

In an embodiment, the gate of the first transistor 312 and the gate of the second transistor 330 are used to receive a control signal Vctrl, and the control signal Vctrl may be enabled in an initial period of the light emitting diode drive circuit, so that the first transistor 312 and the second transistor 330 of each of the pixel units 302 are switched on in the initial period, and a second terminal (end point r) of the second transistor 330 receives an initial voltage.

In this embodiment, each of the pixel units 302 further includes a capacitor 320. A first terminal of the capacitor 320 is electrically connected with the gate of the drive transistor 310. In an embodiment, the capacitor 320 is used to store a data voltage.

In the abovementioned embodiment, by setting a first transistor 312 for each of the pixel units 302, and connecting a gate of the first transistor 312 with a gate of a second transistor 330 outside the pixel unit 302, the first transistor 312 and the second transistor 330 may form a dual-gate structure.

Figure 6B:
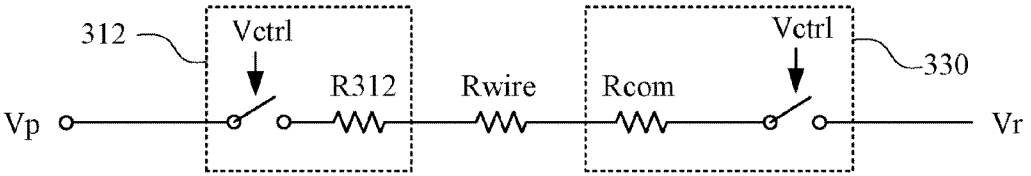
FIG. 6B is an equivalent circuit diagram of a leakage current path of a pixel unit according to an embodiment of the present invention.

Referring to FIG. 6B, FIG. 6B is an equivalent circuit diagram of a leakage current path of a pixel unit 302 shown according to an embodiment. Various pixel units 302 share the same second transistor 330, and each form a dual-gate structure, which is equivalent to that a circuit resistor Rwire of the charge sharing line 120 is additionally serially connected on the equivalent circuit of a current path of the leakage current of the capacitor 320. As shown in FIG. 6A and FIG. 6B, the leakage current flows from the end point p having a voltage Vp (that is, the gate of the drive transistor 310) to the end point r having a voltage Vr (that is, the second terminal of the second transistor 330), and an equivalent resistor on the current path is an equivalent resistor R312 of the first transistor 312, an equivalent resistor Rcom of the second transistor 330 and the parasitic resistor Rwire of the charge sharing line 120 itself, so that the resistance value on the leakage current path is increased. In this way, the leakage current of the capacitor 320, and the mura effect of the display that may be caused by the abovementioned leakage current may be effectively alleviated. In addition, a plurality of pixel units 302 may share one second transistor 330, so that the number of used transistors in the pixel units 302 may be reduced. Therefore, it is unnecessary to occupy an excessive area on the pixel circuit 600.

Figure 7:
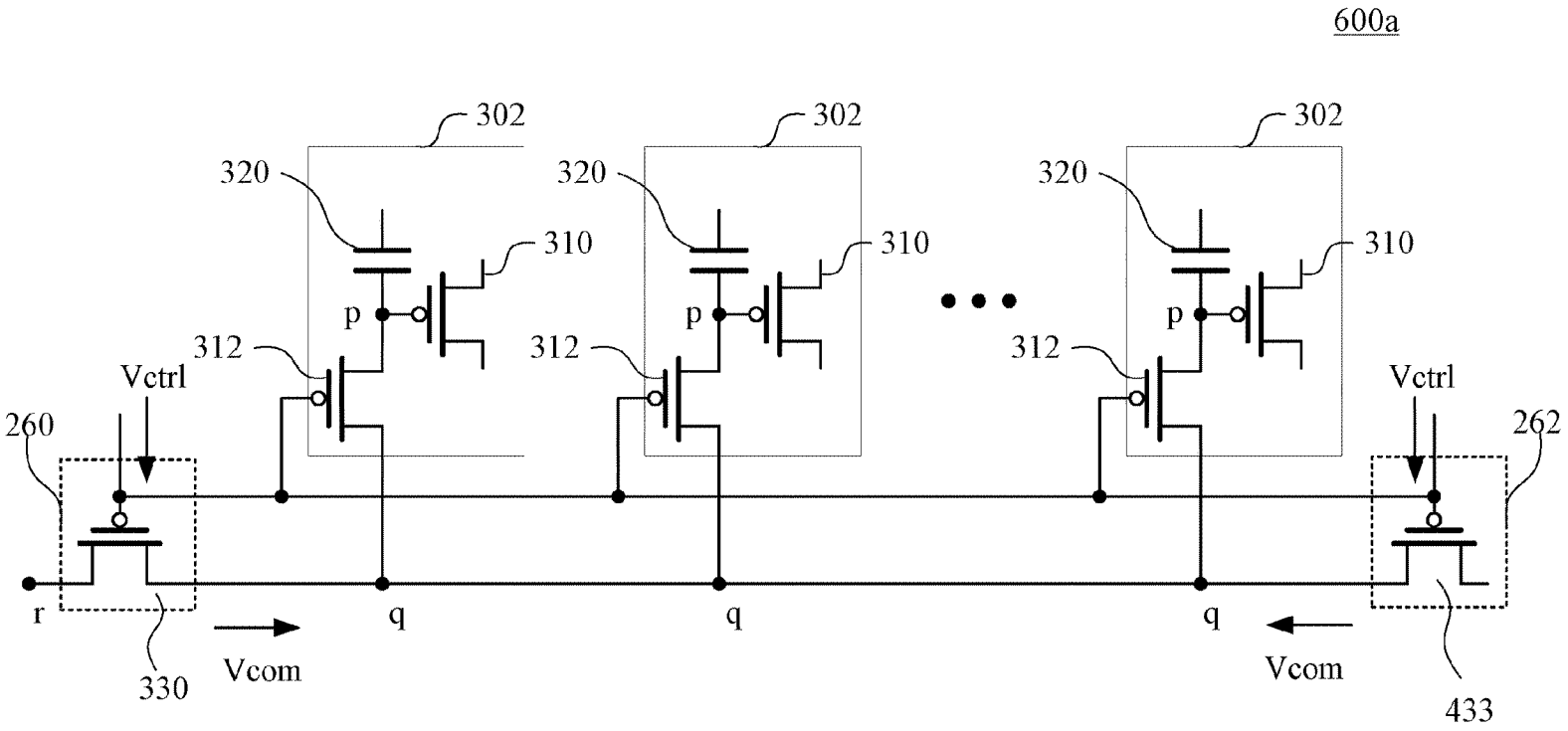
FIG. 7 is a schematic diagram of a pixel circuit according to an embodiment of the present invention.

Referring to FIG. 7, FIG. 7 is a schematic diagram of a pixel circuit 600*a* according to an embodiment of the present invention. Compared with the pixel circuit 600 shown in FIG. 6A, in this embodiment, a switch circuit 262 includes a third transistor 433 (equivalent to the fourth switch unit 286 or 296 in FIG. 5A).

A second terminal of a first transistor 312 of each of pixel units 302 is electrically connected with a first terminal (end point q) of the third transistor 433. A gate of the third transistor 433 is electrically connected with a gate of the first transistor 312 of each of the pixel units 302.

In this embodiment, the function and operation of the third transistor 433 are similar to those of the second transistor 330, which are not repeated herein.

Figure 8:
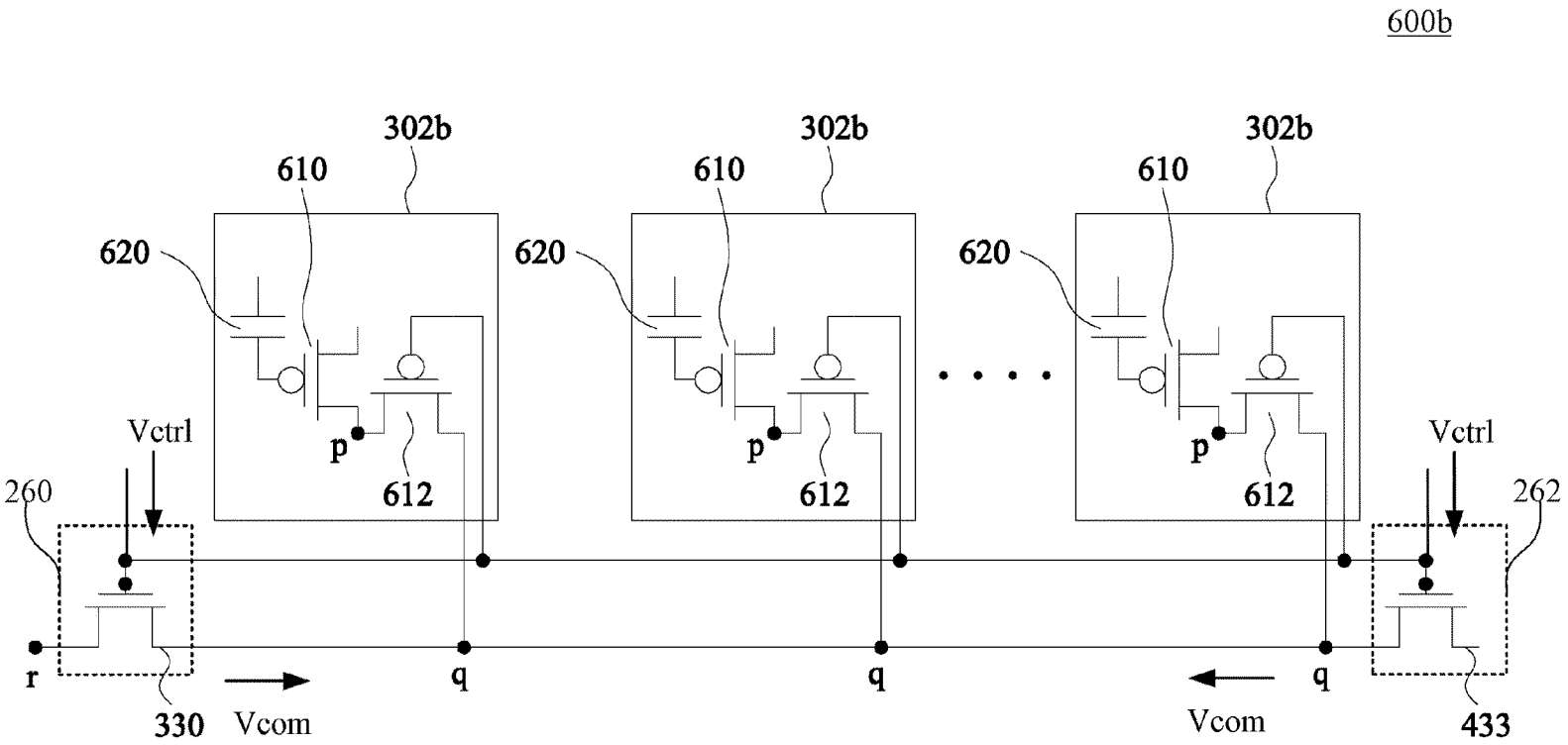
FIG. 8 is a schematic diagram of a pixel circuit according to another embodiment of the present invention.

FIG. 8 is a schematic diagram of a pixel circuit 600*b* according to another embodiment of the present invention. Compared with the pixel circuit 600*a* and the pixel unit 302 therein shown in FIG. 7, in the pixel circuit 600*b* of this embodiment, each of pixel units 302*b* includes a drive transistor 610, a first transistor 612 and a capacitor 620. A gate of the drive transistor 610 is electrically connected with the capacitor 620, and one terminal of the drive transistor 610 is electrically connected with a first terminal (end point p) of the first transistor 612. A second terminal of the first transistor 612 is electrically connected with a first terminal (end point q) of a second transistor 330, and a gate of the second transistor 330 is electrically connected with a gate of the first transistor 612 of each of the pixel units 302*b*.

In an embodiment, each drive transistor 610 is used to provide a drive current to a light emitting element (not shown) in a corresponding pixel unit 302*b*. The abovementioned light emitting element may be a light emitting diode, and the drive transistor 610 may be a drive transistor in a light emitting diode drive circuit (for example, a 6T1C light emitting diode drive circuit). Moreover, each capacitor 620 is used to store a data voltage.

In addition, in an embodiment, the gate of the first transistor 612 and the gate of the second transistor 330 are used to receive a control signal Vctrl, and the control signal Vctrl may be enabled in an initial period of the abovementioned light emitting diode drive circuit, so that the first transistor 612 and the second transistor 330 of each of the pixel units 302*b* are switched on in the initial period, and a second terminal (end point r) of the second transistor 330 receives an initial voltage. Other operations are similar to those in the abovementioned descriptions, and are therefore not repeated herein.

It should be noted that, the circuit configuration in the abovementioned pixel unit 302*b* may also be applied to the embodiment shown in FIG. 6A, and therefore, the embodiment shown in FIG. 6A is not limited to the drawing.

Figure 9A:
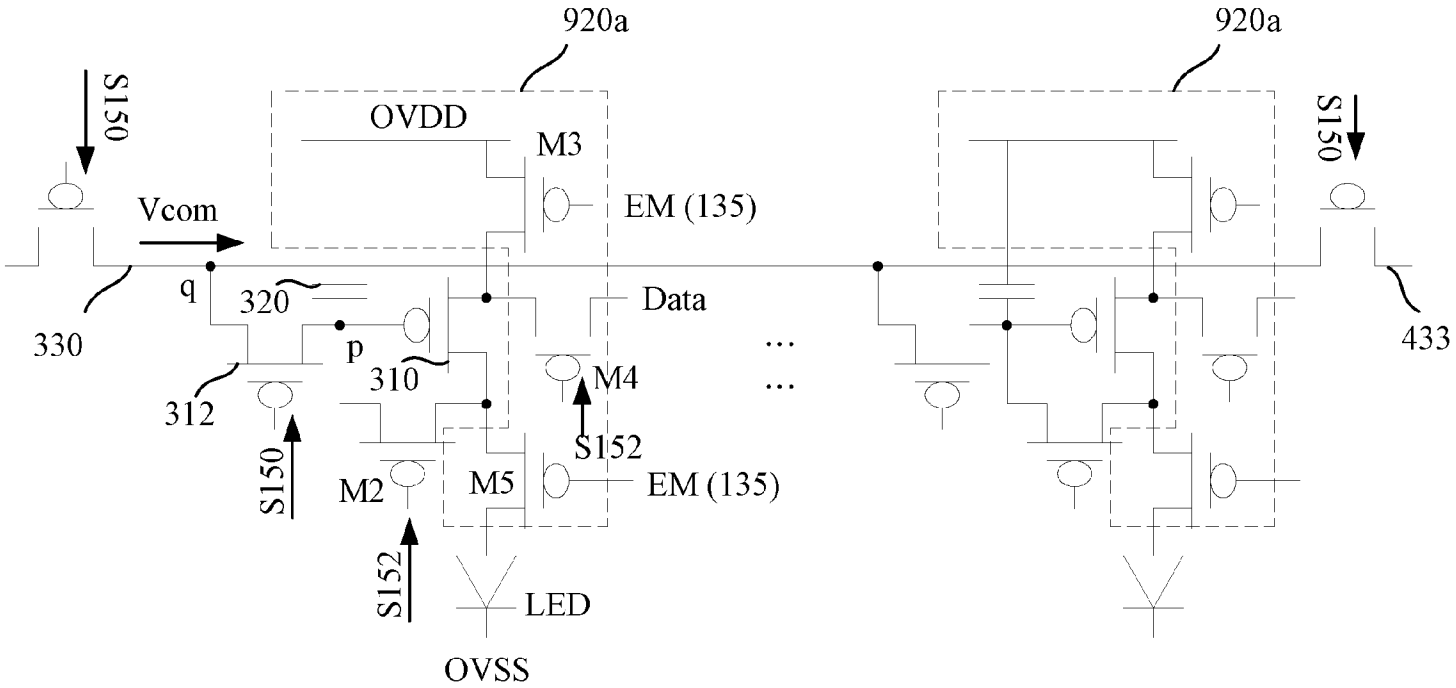
FIG. 9A and FIG. 9B are respectively schematic diagrams of a pixel circuit according to an embodiment of the present invention.

To further describe the structure of a compensation circuit in the pixel circuit 600, please refer to FIG. 9A, and FIG. 9A is a schematic diagram of a pixel circuit 600 according to an embodiment of the present invention. For convenience, the embodiment shown in FIG. 9A will be described together with the drive signal in FIG. 4 and the embodiment in FIG. 7.

Similar to the embodiment shown in FIG. 7, each of pixel units includes a drive transistor 310 and a first transistor 312. A gate of the drive transistor 310 is electrically connected with a first terminal (end point p) of the first transistor 312. In an embodiment, the drive transistor 310 is used to provide a drive current to a light emitting element LED in the pixel unit. The abovementioned light emitting element may be a light emitting diode, and the drive transistor 310 may be a drive transistor in a light emitting diode drive circuit (for example, a 6T1C light emitting diode drive circuit).

As shown in FIG. 9A, in this embodiment, the light emitting diode drive circuit is the 6T1C light emitting diode drive circuit, and a compensation circuit 920*a* in the light emitting diode drive circuit includes transistors M3, M4 and M5. In structure, a first terminal of the transistor M3 is connected with a power supply positive potential OVDD, a second terminal of the transistor M3 is connected with a first terminal of the drive transistor 310, a control terminal of the transistor M3 is used to receive a light-emission enable signal EM(135). A first terminal of the transistor M4 is connected with the first terminal of the drive transistor 310, a second terminal of the transistor M4 is used to be connected with the data line 122 to receive a signal Data (that is, a voltage signal on the data line 122), and a control terminal of the transistor M4 is used to receive a switch control signal S152, so that the transistor M4 is switched on in the charge sharing period 572. A first terminal of the transistor M5 is connected with a second terminal of the drive transistor 310, a second terminal of the transistor M5 is connected with a power supply negative potential OVSS, and a control terminal of the transistor M5 is used to receive the light-emission enable signal EM(135).

Figure 9B:
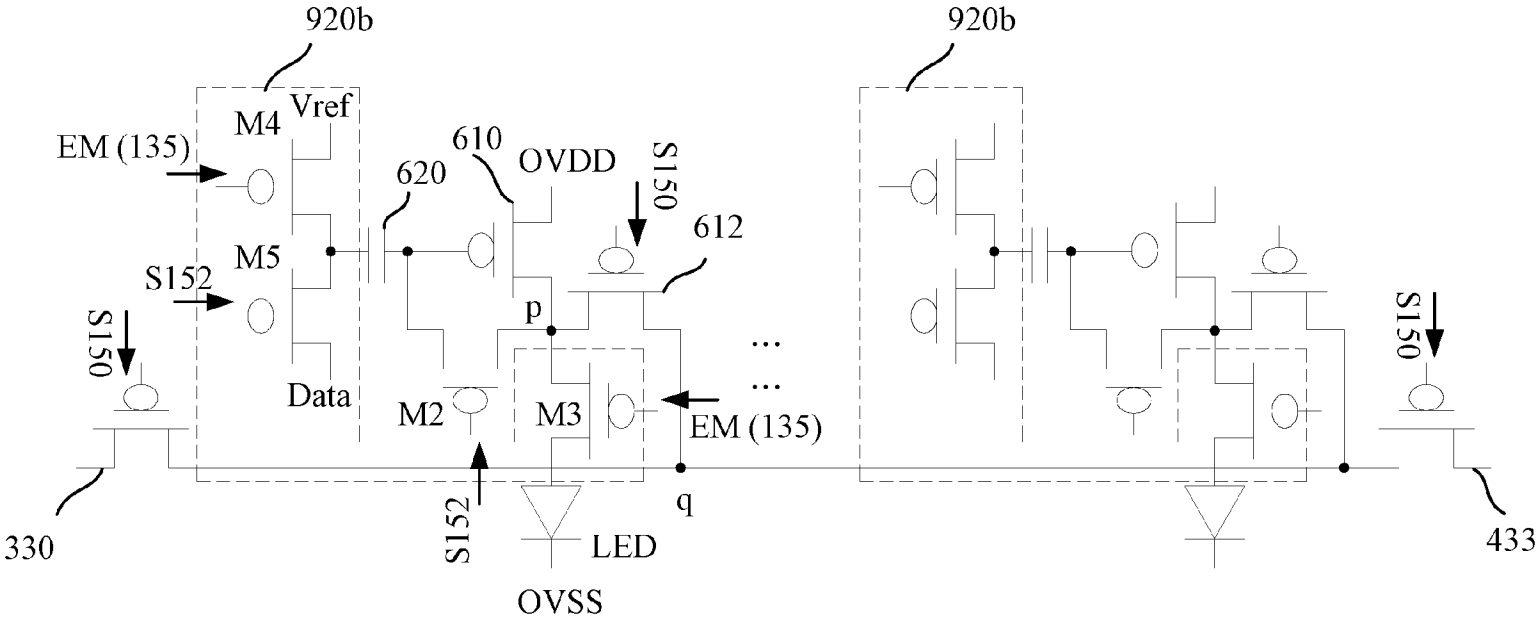

Referring to FIG. 9B, FIG. 9B is a schematic diagram of a pixel circuit 600 according to another embodiment of the present invention. For convenience, the embodiment shown in FIG. 9B will be described together with the drive signal in FIG. 4 and the embodiment in FIG. 8.

Similar to the embodiment shown in FIG. 8, each of pixel units includes a drive transistor 610, a first transistor 612 and a capacitor 620. A gate of the drive transistor 610 is electrically connected with the capacitor 620, and one terminal of the drive transistor 610 is electrically connected with a first terminal (end point p) of the first transistor 612. A second terminal of the first transistor 612 is electrically connected with a first terminal (end point q) of a second transistor 330, and a gate of the second transistor 330 is electrically connected with a gate of the first transistor 612 of each of the pixel units 302*b*, so as to receive a switch control signal S150.

As shown in FIG. 9B, in this embodiment, the light emitting diode drive circuit is the 6T1C light emitting diode drive circuit, and a compensation circuit 920*b* in the light emitting diode drive circuit includes transistors M3, M4 and M5. In structure, a first terminal of the transistor M3 is connected with a first terminal (end point p) of the first transistor 612, a second terminal of the transistor M3 is connected with a power supply negative potential OVSS, and a control terminal of the transistor M3 is used to receive a light-emission enable signal EM(135). A first terminal of the transistor M4 is connected with a reference voltage Vref, a second terminal of the transistor M4 is used to be connected with one terminal of the capacitor 620, and a control terminal of the transistor M4 is used to receive the light-emission enable signal EM(135). A first terminal of the transistor M5 is connected with the second terminal of the transistor M4, a second terminal of the transistor M5 is used to be connected with the data line 122 to receive a signal Data (that is, a voltage signal on the data line 122), and a control terminal of the transistor M5 is used to receive a switch control signal S152, so that the transistor M5 is switched on in the charge sharing period 572.

To sum up, by means of the technical means of the present invention, the power required to be consumed when the data voltage is provided may be effectively reduced. Particularly, when a difference between the first data voltage and the second data voltage is large, the power consumed when the data voltage is provided may be greatly reduced. The power consumed by the pixel circuit of this application is about 34% of that in the conventional technology. In addition, in the present invention, by setting a first transistor for each of pixel units, and connecting a gate of the first transistor with a gate of a second transistor outside the pixel unit, the first transistor and the second transistor may form a dual-gate structure. In this way, the mura effect of the display caused by the leakage current may be effectively alleviated. Moreover, because a plurality of pixel units may share one second transistor, it is unnecessary to occupy an excessive area on the pixel circuit. Along with the increase of resolution, the proportion of area saved by the pixel circuit is also increased. In different embodiments, the pixel circuits of this application may respectively save the region area of about 5%, 9%, 20%, and 36%. In this way, in a high-pixel density pixel circuit, sufficient capacitor layout space may be provided for compensation, and the leakage current level in the pixel circuit may be kept.

Compared with the prior art, the technical solution provided in this application may achieve charge sharing by using one data line, and it is merely required to perform operation by using the first switch unit and the second switch unit in each pixel unit together with the shared fourth switch unit. Moreover, the pixel circuit of this application correspondingly controls a plurality of pixel units by using one control voltage Vcom, and obviates the need to configure extra additional capacitors, thereby reducing the circuit area and element cost.

Although the disclosure content has been disclosed in the above implementation manners, it is not intended to limit the disclosure content, and any person skilled in the art can make various modifications and improvements without departing from the spirit and scope of the disclosure content; therefore, the protection scope of the disclosure should be subject to the appended claims.

What is claimed is:

1. A pixel circuit operating in an sequential order of a first period, a second period, and a third period, comprising:

a first switch unit with a first terminal and a second terminal;

a second switch unit with a third terminal and a fourth terminal;

a data line, electrically connected with said third terminal;

a charge sharing line, electrically connected with said second terminal and said fourth terminal;

a third switch unit with a fifth terminal and a sixth terminal, the fifth terminal being electrically connected with the data line;

a fourth switch unit with a seventh terminal and eighth terminal, the seventh terminal being electrically connected with the charge sharing line; and a pixel-driving unit electrically connected with said data line and said first terminal;

wherein the first period is an initial period and during the first period:

the third switch unit is switched on to transmit a first voltage value through the third switch unit and the data line to an adjacent pixel-driving unit; and the fourth switch unit is switched on to transmit a third voltage value through the fourth switch unit to the charge sharing line;

wherein the third period is a compensation period and during the third period:

the third switch unit is switched on to transmit a fifth voltage value via the data line to the pixel-driving unit.

2. The pixel circuit according to claim 1, wherein the second period is a charge-sharing period, and when in the second period, the first switch unit is switched off, and the second switch unit is switched on.

3. The pixel circuit according to claim 1, wherein the first period is an initial period, and when in the first period, the first switch unit is switched on, the second switch unit is switched off.

4. The pixel circuit according to claim 1, wherein during the first period, the data line provides a data voltage of an adjacent pixel-driving unit.

5. The pixel circuit according to claim 1, wherein the third period is a compensation period, a fourth period follows said third period, and the fourth period is a light emission period;

wherein when in the third period, the first switch unit is switched off, the second switch unit is switched off, and the data line provides a data voltage value to the pixel-driving unit; and when in the fourth period, the first switch unit is switched off, the second switch unit is switched off, and the pixel-driving unit receives a light-emission enable signal to enable a light emitting element in the pixel-driving unit.

6. The pixel circuit according to claim 1, wherein the third period is a compensation period, and when in the third period, the third switch unit is switched on for transmitting a first data voltage on the data line to the pixel-driving unit.

7. The pixel circuit according to claim 1, wherein the second period is a charge-sharing period, and when in the second period, the fourth switch unit is switched off, the first switch unit is switched off, and the second switch unit is switched on.

8. A pixel circuit operating in an sequential order of a first period, a second period, and a third period, comprising:

a first switch unit with a first terminal and a second terminal;

a second switch unit with a third terminal and a fourth terminal;

a data line, electrically connected to the fourth terminal, wherein said data line has a first voltage value during said first period and a second voltage value during said second period;

a charge sharing line, electrically connected to the second terminal and the third terminal, wherein said charge sharing line has a third voltage value during said first period and a fourth voltage value during said second period;

a third switch unit with a fifth terminal and a sixth terminal, the fifth terminal being electrically connected with the data line;

a fourth switch unit with a seventh terminal and eighth terminal, the seventh terminal being electrically connected with the charge sharing line;

a first pixel-driving unit, electrically connected with the data line; and a second pixel-driving unit, electrically connected with the data line and the first terminal of the first switch unit;

wherein, said second voltage value is determined according to the first voltage value and third voltage value;

wherein the first period is an initial period and corresponds to a compensation period, and during the first period:

the third switch unit is switched on to transmit the first voltage value through the third switch unit and the data line to the first pixel-driving unit; and the fourth switch unit is switched on to transmit the third voltage value through the fourth switch unit to the charge sharing line;

wherein the third period is a compensation period, and during the third period:

the third switch unit is switched on to transmit a fifth voltage value via the data line to the first pixel-driving unit.

9. The pixel circuit according to claim 8, wherein the second period is a charge sharing period corresponding to the second pixel-driving unit, and when in the second period, the first switch unit is switched off, and the second switch unit is switched on, so that second voltage value the fourth voltage value are the same.

10. The pixel circuit according to claim 8, wherein the first period is an initial period corresponding to the second pixel-driving unit, and when in the first period, the first switch unit is switched on, the second switch unit is switched off, and the charge sharing line provides the third voltage value to serve as an initial voltage of the second pixel-driving unit.

11. The pixel circuit according to claim 8, wherein the second period is a charge sharing period corresponding to the second pixel-driving unit, and when in the second period, the fourth switch unit is switched off, the first switch unit is switched off, and the second switch unit is switched on, so that second voltage value and the fourth voltage value are the same.

12. A method for operating a pixel circuit according to a plurality of sequential time periods, the plurality of sequential time periods comprising a first period, a second period, and a third period the pixel circuit comprising a pixel unit, and the method comprising:

providing the pixel unit, the pixel unit comprising:

a first switch unit with a first terminal and a second terminal;

a second switch unit with a third terminal and a fourth terminal;

a data line, electrically connected with said third terminal, wherein said data line has a first voltage value during said first period and a second voltage value during said second period;

a charge sharing line, electrically connected with said second terminal and said fourth terminal, wherein said charge sharing line has a third voltage value during said first period and a fourth voltage value during said second period;

a third switch unit with a fifth terminal and a sixth terminal, the fifth terminal being electrically connected with the data line;

a fourth switch unit with a seventh terminal and eighth terminal, the seventh terminal being electrically connected with the charge sharing line; and a pixel-driving unit electrically connected with said data line and said first terminal; and determining said second voltage value according to said first voltage value and said third voltage value;

wherein the first period is an initial period and during the first period:

switching the third switch unit on and transmitting the first voltage value through the third switch unit and the data line to an adjacent pixel-driving unit; and switching the fourth switch unit on and transmitting the third voltage value through the fourth switch unit to the charge sharing line;

wherein the third period is a compensation period and during the third period:

switching the third switch unit on; and providing a fifth voltage value via the data line to the pixel-driving unit.

13. The method according to claim 12, wherein the second period is a charge-sharing period, and when in the second period, the method further comprises:

switching the first switch unit off; and switching the second switch unit on, so that the fourth voltage value and the second voltage value are the same.

14. The method according to claim 12, wherein the first period is an initial period, and when in the first period, the method further comprises:

switching the first switch unit on;

switching the second switch unit off; and providing the third voltage value via the charge sharing line to serve as an initial voltage of the pixel-driving unit.

15. The pixel circuit according to claim 12, wherein a fourth period follows said third period, and the fourth period is a light emission period, wherein:

when in the third period, the method further comprising:

switching the first switch unit off;

switching the second switch unit off; and providing a fifth voltage value to the pixel driving unit via the data line, to serve as a data voltage of the pixel-driving unit; and when in the fourth period, the method further comprising:

switching the first switch unit off;

switching the second switch unit off; and receiving a light-emission enable signal via the pixel-driving unit to enable a light emitting element in the pixel-driving unit.

* * * * *